US009321149B2

(12) United States Patent
Van et al.

(10) Patent No.: US 9,321,149 B2
(45) Date of Patent: Apr. 26, 2016

(54) COMPOSITE ABRASIVE WHEEL

(71) Applicant: 3M INNOVATIVE PROPERTIES COMPANY, St. Paul, MN (US)

(72) Inventors: Loc X. Van, Woodbury, MN (US); Thu A. Nguyen, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/353,467

(22) PCT Filed: Nov. 6, 2012

(86) PCT No.: PCT/US2012/063662

§ 371 (c)(1),
(2) Date: Apr. 22, 2014

(87) PCT Pub. No.: WO2013/070576

PCT Pub. Date: May 16, 2013

(65) Prior Publication Data

US 2014/0256238 A1 Sep. 11, 2014

Related U.S. Application Data

(60) Provisional application No. 61/557,563, filed on Nov. 9, 2011.

(51) Int. Cl.
*B24D 7/14* (2006.01)
*B24D 3/20* (2006.01)
(Continued)

(52) U.S. Cl.
CPC .. *B24D 7/14* (2013.01); *B24D 3/20* (2013.01); *B24D 5/12* (2013.01); *B24D 5/14* (2013.01)

(58) Field of Classification Search
CPC ..... B24D 7/14; B24D 3/20; B24D 3/34; B24D 9/00; B24D 7/00; C09K 3/14
USPC ..... 451/548, 541, 546, 544; 51/297, 298, 51/293
See application file for complete search history.

(56) References Cited

U.S. PATENT DOCUMENTS 1,910,444 A 5/1933 Nicholson
3,041,156 A 6/1962 Rowse
(Continued)

FOREIGN PATENT DOCUMENTS

CN 1449893 A 10/2003
CN 101394972 A 11/2004
(Continued)

OTHER PUBLICATIONS

International Search Report for PCT International Application No. PCT/US2012/063662, mailed on Mar. 11, 2013, 3pgs.
(Continued)

*Primary Examiner* — Robert Rose
(74) *Attorney, Agent, or Firm* — Bradford B. Wright

(57) ABSTRACT

A composite abrasive wheel comprises primary and secondary abrasive portions. The primary abrasive portion comprises shaped ceramic abrasive particles retained in a first organic binder. The secondary abrasive portion is bonded to the primary abrasive portion, and comprises secondary crushed abrasive particles retained in a second organic binder. The primary abrasive portion comprises a larger volume percentage of the shaped ceramic abrasive particles than the secondary abrasive portion. A central aperture extends through the composite abrasive wheel.

15 Claims, 1 Drawing Sheet

(51) Int. Cl.
*B24D 5/12* (2006.01)
*B24D 5/14* (2006.01)

(56) References Cited

U.S. PATENT DOCUMENTS

| | | | |
|---|---|---|---|
| 3,067,551 | A | 12/1962 | Maginnis |
| 3,081,584 | A | 3/1963 | Bullard |
| 3,136,100 | A | 6/1964 | Robertson, Jr. |
| 3,500,592 | A | 3/1970 | Harrist |
| 3,596,415 | A | 8/1971 | Donahue |
| 3,867,795 | A | 2/1975 | Howard |
| 4,314,827 | A | 2/1982 | Leitheiser |
| 4,623,364 | A | 11/1986 | Cottringer |
| 4,744,802 | A | 5/1988 | Schwabel |
| 4,770,671 | A | 9/1988 | Monroe |
| 4,867,758 | A | 9/1989 | Newkirk |
| 4,881,951 | A | 11/1989 | Wood |
| 4,997,461 | A | 3/1991 | Markhoff-Matheny |
| 5,009,675 | A | 4/1991 | Kunz |
| 5,011,508 | A | 4/1991 | Wald |
| 5,042,991 | A | 8/1991 | Kunz |
| 5,085,671 | A | 2/1992 | Martin |
| 5,152,917 | A | 10/1992 | Pieper |
| 5,164,348 | A | 11/1992 | Wood |
| 5,213,591 | A | 5/1993 | Celikkaya |
| 5,352,254 | A | 10/1994 | Celikkaya |
| 5,435,816 | A | 7/1995 | Spurgeon |
| 5,551,963 | A | 9/1996 | Larmie |
| 5,645,619 | A | 7/1997 | Erickson |
| 5,672,097 | A | 9/1997 | Hoopman |
| 5,725,421 | A | 3/1998 | Goers |
| 5,876,470 | A * | 3/1999 | Abrahamson ..... B24D 3/00 51/307 |
| 5,946,991 | A | 9/1999 | Hoopman |
| 5,975,987 | A | 11/1999 | Hoopman |
| 6,129,540 | A | 10/2000 | Hoopman |
| 6,277,161 | B1 | 8/2001 | Castro |
| 2002/0026752 | A1 | 3/2002 | Culler |
| 2009/0165394 | A1 | 7/2009 | Culler |
| 2009/0169816 | A1 | 7/2009 | Erickson |
| 2013/0040537 | A1 | 2/2013 | Schwabel |
| 2013/0203328 | A1 | 8/2013 | Givot |

FOREIGN PATENT DOCUMENTS

| | | | |
|---|---|---|---|
| CN | 1980773 | A | 6/2007 |
| JP | 08-090423 | | 4/1996 |
| JP | 2003-300166 | A | 10/2003 |
| JP | 2004-306172 | A | 11/2004 |
| WO | WO 2011-109188 | | 9/2011 |

OTHER PUBLICATIONS

Extended European Search Report, EP12847458, Jun. 26, 2015, 3 pages.

* cited by examiner

COMPOSITE ABRASIVE WHEEL

TECHNICAL FIELD

The present disclosure relates to bonded abrasive wheels.

BACKGROUND

Bonded abrasive articles have abrasive particles bonded together by a bonding medium. The bonding medium is typically an organic resin, but may also be an inorganic material such as a ceramic or glass (i.e., vitreous bonds). Examples of bonded abrasive articles include stones, hones, and abrasive wheels such as, for example, grinding wheels and cut-off wheels.

Grinding wheels are of various shapes may be, for example, driven by a stationary-mounted motor such as, for example, a bench grinder, or attached and driven by a hand-operated portable grinder. Hand-operated portable grinders are typically held at a slight angle relative to the workpiece surface, and may be used to grind, for example, welding beads, flash, gates, and risers off castings.

SUMMARY

In one aspect, the present disclosure provides a composite abrasive wheel comprising:

a primary abrasive portion defining a front surface, wherein the primary abrasive portion comprises shaped ceramic abrasive particles retained in a first organic binder;

a secondary abrasive portion defining a back surface opposite the front surface, wherein the secondary abrasive portion is bonded to the primary abrasive portion, wherein the secondary abrasive portion comprises secondary crushed abrasive particles retained in a second organic binder, wherein the primary abrasive portion comprises a larger volume percentage of the shaped ceramic abrasive particles than the secondary abrasive portion; and wherein the composite abrasive wheel has a central aperture therein that extends from the front surface to the back surface.

In some embodiments, the first organic binder and the second organic binder are different.

In some embodiments, the secondary abrasive portion is substantially free of the shaped ceramic abrasive particles. In some embodiments, the shaped ceramic abrasive particles comprise truncated triangular pyramids. In some embodiments, the truncated triangular pyramids have a slope angle in a range of from 75 to 85 degrees.

In some embodiments, the primary abrasive portion further comprises diluent crushed abrasive particles. In some embodiments, the diluent crushed abrasive particles have a smaller mean particle size than the shaped ceramic abrasive particles.

In some embodiments, the shaped ceramic abrasive particles have a ratio of maximum length to thickness of from 1:1 to 8:1. In some embodiments, the shaped ceramic abrasive particles have a ratio of maximum length to thickness of from 2:1 to 5:1. In some embodiments, the shaped ceramic abrasive particles comprise sol-gel-derived shaped alumina abrasive particles. In some embodiments, the shaped ceramic abrasive particles have a coating of inorganic particles thereon. In some embodiments, the primary abrasive portion further comprises a first reinforcing fabric adjacent the front surface, and wherein the secondary abrasive portion further comprises a second reinforcing fabric adjacent the back surface of the secondary abrasive portion. In some embodiments, the composite abrasive wheel has a depressed center portion encircling the central aperture. In some embodiments, the present disclosure provides a composite abrasive wheel according to any of the first to thirteenth embodiments, the primary abrasive portion comprises from 66 to 74 percent by weight of shaped alumina abrasive particles, from 14 to 20 percent by weight of an organic binder derived from a liquid phenolic resin and a solid phenolic resin, and 10 to 15 percent by weight of grinding aid particles. In some embodiments, at least one of the first or second binder comprises an at least partially cured phenolic resin.

As used, herein the term "shaped ceramic abrasive particle" refers to a ceramic abrasive particle with at least a portion of the abrasive particle having a predetermined shape that substantially replicates a mold cavity used to form the shaped precursor particle that is subsequently sintered to form the shaped ceramic abrasive particle. The term "shaped ceramic abrasive particle", as used herein, excludes abrasive particles obtained by a random crushing or fracturing (e.g., mechanical crushing) operation.

Features and advantages of the present disclosure will be further understood upon consideration of the detailed description and drawings as well as the appended claims.

Additional embodiments of the present disclosure beyond the description in the above-referenced drawing figures are also contemplated, for example, as noted in the discussion. The figures may not be drawn to scale. Like reference numbers may have been used throughout the figures to denote like parts.

DETAILED DESCRIPTION

Figure 1:
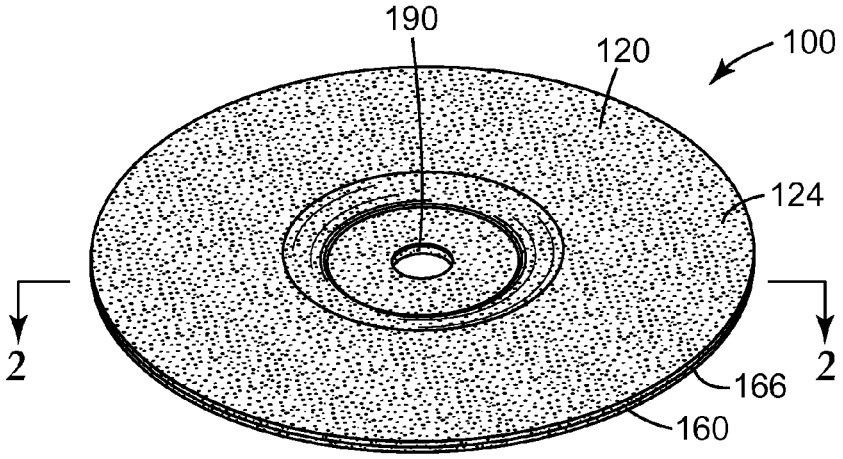
FIG. 1 is a perspective view of an exemplary composite abrasive wheel 100 according to the present disclosure.
Figure 2:
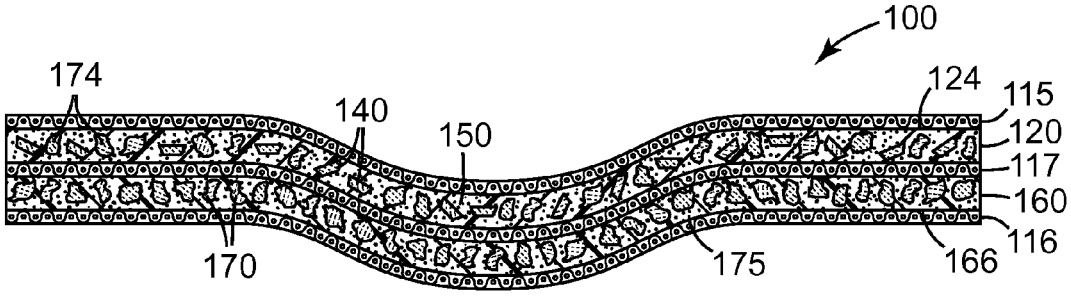
FIG. 2 is a view of cross-sectional plane 2-2 shown in FIG. 1.

Referring now to FIGS. 1 and 2, exemplary composite abrasive wheel 100 according to one embodiment of the present disclosure comprises primary abrasive portion 120 which defines front surface 124. Primary abrasive portion 120 comprises shaped ceramic abrasive particles 140 and optional diluent crushed abrasive particles 174 retained in a first organic binder 150. Secondary abrasive portion 160 defines a back surface 166 opposite front surface 124. Secondary abrasive portion 160 is bonded to primary abrasive portion 120. Secondary abrasive portion 160 comprises secondary crushed abrasive particles 170 retained in second organic binder 175. Second organic binder 175 may be the same as, or different than, first organic binder 150. Primary abrasive portion 120 comprises a larger volume percentage of the shaped ceramic abrasive particles 140 than secondary abrasive portion 160. Composite abrasive wheel 100 has central aperture 190 that extends from front surface 124 to back surface, which can be used, for example, for attachment to a power driven tool. Primary abrasive portion 120 optionally further comprises primary reinforcing material 115 adjacent to front surface 124 primary abrasive portion 120. Secondary abrasive portion 160 optionally further comprises secondary reinforcing material 116 adjacent to back surface 166. Optional reinforcing material 117 is sandwiched between, and/or is disposed at the junction of, primary abrasive portion 120 and secondary abrasive portion 160. In some embodiments, the primary and secondary abrasive portions contact each other, while in other embodiments they a bonded to one another through one or more additional elements (e.g., a layer of a third organic binder optionally including reinforcing material 117).

Typically, the secondary abrasive portion contains less than 90 percent by volume, less than 80 percent by volume, less than 70 percent by volume, less than 60 percent by volume, less than 50 percent by volume, less than 40 percent by volume, less than 30 percent by volume, less than 20 percent by volume, less than less than 10 percent by volume, less than 5 percent by volume, or even less than one percent by volume, of the shaped ceramic abrasive particles. In some embodiments, the secondary abrasive portion is free of the shaped ceramic abrasive particles.

Composite abrasive wheels may be molded to the shape of, for example, a shallow or flat dish or saucer with curved or straight flaring sides, and may have either a straight or depressed center portion encircling and adjacent to the central aperture (e.g., as in a Type 27 depressed center grinding wheel). As used herein, the term "straight center" is meant to include composite abrasive wheels other than depressed-center or raised-hub abrasive wheels, and those having front and back surfaces which continue without any deviation or sharp bends to the central aperture. The composite abrasive wheel can be adapted adjacent to, or within, the central aperture (i.e., a center mounting hole) to receive any suitable mounting or adapter, for example, for attaching the composite abrasive wheel to the drive spindle or shaft of a portable grinder, for example, as described in U.S. Pat. No. 3,081,584 (Bullard); U.S. Pat. No. 3,136,100 (Robertson, Jr.); U.S. Pat. No. 3,500,592 (Harrist) and U.S. Pat. No. 3,596,415 (Donahue), the disclosures of which are incorporated herein by reference. There are many other types of suitable mountings known to those skilled in the art which may be attached in various ways to the abrasive wheels.

Organic binders are preferably included in the first and secondary abrasive portions in amounts of from 5 to 30 percent, more preferably 10 to 25, and even more preferably 15 to 24 percent by weight, based on the total weight of the respective first and secondary abrasive portions, however other amounts may also be used. The organic binder is typically formed by at least partially curing a corresponding organic binder precursor.

Phenolic resin is an exemplary useful organic binder precursor, and may be used in powder form and/or liquid state. Organic binder precursors that can be cured (i.e., polymerized and/or crosslinked) to form useful organic binders include, for example, one or more phenolic resins (including novolac and/or resole phenolic resins) one or more epoxy resins, one or more urea-formaldehyde binders, one or more polyester resins, one or more polyimide resins, one or more rubbers, one or more polybenzimidazole resins, one or more shellacs, one or more acrylic monomers and/or oligomers, and combinations thereof. The organic binder precursor(s) may be combined with additional components such as, for example, curatives, hardeners, catalysts, initiators, colorants, antistatic agents, grinding aids, and lubricants. Conditions for curing each of the foregoing are well-known to those of ordinary skill in the art.

The first organic binder and the second organic binder may be the same or different (e.g., chemically different). For example, the first organic binder may be a first phenolic binder and the second organic binder may be a second phenolic binder that is chemically different than the first phenolic binder.

Useful phenolic resins include novolac and resole phenolic resins. Novolac phenolic resins are characterized by being acid-catalyzed and having a ratio of formaldehyde to phenol of less than one, typically between 0.5:1 and 0.8:1. Resole phenolic resins are characterized by being alkaline catalyzed and having a ratio of formaldehyde to phenol of greater than or equal to one, typically from 1:1 to 3:1. Novolac and resole phenolic resins may be chemically modified (e.g., by reaction with epoxy compounds), or they may be unmodified. Exemplary acidic catalysts suitable for curing phenolic resins include sulfuric, hydrochloric, phosphoric, oxalic, and p-toluenesulfonic acids. Alkaline catalysts suitable for curing phenolic resins include sodium hydroxide, barium hydroxide, potassium hydroxide, calcium hydroxide, organic amines, or sodium carbonate.

Phenolic resins are well-known and readily available from commercial sources. Examples of commercially available novolac resins include DUREZ 1364, a two-step, powdered phenolic resin (marketed by Durez Corporation, Addison, Tex., under the trade designation VARCUM (e.g., 29302), or HEXION AD5534 RESIN (marketed by Hexion Specialty Chemicals, Inc., Louisville, Ky.). Examples of commercially available resole phenolic resins useful in practice of the present disclosure include those marketed by Durez Corporation under the trade designation VARCUM (e.g., 29217, 29306, 29318, 29338, 29353); those marketed by Ashland Chemical Co., Bartow, Fla. under the trade designation AEROFENE (e.g., AEROFENE 295); and those marketed by Kangnam Chemical Company Ltd., Seoul, South Korea under the trade designation "PHENOLITE" (e.g., PHENOLITE TD-2207).

Curing temperatures of organic binder precursors will vary with the material chosen and wheel design. Selection of suitable conditions is within the capability of one of ordinary skill in the art. Exemplary conditions for a phenolic binder may include an applied pressure of about 20 tons per 4 inches diameter (224 kg/cm$^2$) at room temperature followed by heating at temperatures up to about 185° C. for sufficient time to cure the organic binder material precursor.

Composite abrasive wheels according to the present disclosure can be made by a molding process. During molding, first and second organic binder precursors, which may be liquid or powdered, or a combination of liquid and powder, is mixed with abrasive particles. In some embodiments, a liquid medium (either curable organic resin or a solvent) is first applied to the abrasive particles to wet their outer surface, and then the wetted abrasive particles are mixed with a powdered organic binder precursor. Composite abrasive wheels according to the present disclosure may be made, for example, by compression molding, injection molding, and/or transfer molding.

The composite abrasive wheels, optionally including one or more reinforcement materials, may be molded either by hot or cold pressing in any suitable manner well known to those skilled in the art.

For example, in one exemplary process, a mold having a central-aperture-forming arbor surrounded by a circular cavity in which the center is depressed may be used to mold depressed-center or raised-hub wheels. Abrasive wheels may be molded by first placing a disc of reinforcing material having a center hole around the arbor and in contact with the bottom of the mold. Then, spreading a uniform layer of a second curable mixture comprising the first crushed abrasive particles, and the second organic binder precursor on top of the disc of reinforcing material. Next, another disc of reinforcing material with a center hole positioned around the arbor is placed onto the layer of the second curable mixture, followed by spreading a uniform layer of the first curable mixture comprising shaped ceramic abrasive particles, optional diluent crushed abrasive particles and the first binder precursor thereon. Lastly, a hub reinforcing disc with a center hole therein is placed around the arbor and onto the layer of the first curable mixture, and a top mold plate of the desired shape to either produce the depressed center or the straight center hub portion of the wheels, is placed on top of the layers to form a mold assembly. The mold assembly is then placed between the platens of either a conventional cold or hot press. Then the press is actuated to force the mold plate downwardly and compress the discs and abrasive mixtures together, at a pressure of from 1 to 4 tons per square inch, into a self supporting structure of predetermined thickness, diameter and density. After molding the wheel is stripped from the mold and placed in an oven heated (e.g., to a temperature of approximately 175° C. for approximately 6 hours) to cure the curable mixtures and convert the organic binder precursors into useful organic binders.

In some embodiments, the primary abrasive portion includes from about 10 to about 60 percent by weight of the shaped ceramic abrasive particles; preferably from about 30 to about 60 percent by weight, and more preferably from about 40 to about 60 percent by weight, based on the total weight of the binder material and abrasive particles.

Shaped ceramic abrasive particles composed of crystallites of alpha alumina, magnesium alumina spinel, and a rare earth hexagonal aluminate may be prepared using sol-gel precursor alpha alumina particles according to methods described in, for example, U.S. Pat. No. 5,213,591 (Celikkaya et al.) and U.S. Publ. Patent Appln. Nos. 2009/0165394 A1 (Culler et al.) and 2009/0169816 A1 (Erickson et al.).

In some embodiments, alpha alumina based shaped ceramic abrasive particles can be made according to a multistep process. Briefly, the method comprises the steps of making either a seeded or non-seeded sol-gel alpha alumina precursor dispersion that can be converted into alpha alumina; filling one or more mold cavities having the desired outer shape of the shaped abrasive particle with the sol-gel, drying the sol-gel to form precursor shaped ceramic abrasive particles; removing the precursor shaped ceramic abrasive particles from the mold cavities; calcining the precursor shaped ceramic abrasive particles to form calcined, precursor shaped ceramic abrasive particles, and then sintering the calcined, precursor shaped ceramic abrasive particles to form shaped ceramic abrasive particles. The process will now be described in greater detail.

The first process step involves providing either a seeded or non-seeded dispersion of an alpha alumina precursor that can be converted into alpha alumina. The alpha alumina precursor dispersion often comprises a liquid that is a volatile component. In one embodiment, the volatile component is water. The dispersion should comprise a sufficient amount of liquid for the viscosity of the dispersion to be sufficiently low to enable filling mold cavities and replicating the mold surfaces, but not so much liquid as to cause subsequent removal of the liquid from the mold cavity to be prohibitively expensive. In one embodiment, the alpha alumina precursor dispersion comprises from 2 percent to 90 percent by weight of the particles that can be converted into alpha alumina, such as particles of aluminum oxide monohydrate (boehmite), and at least 10 percent by weight, or from 50 percent to 70 percent, or 50 percent to 60 percent, by weight of the volatile component such as water. Conversely, the alpha alumina precursor dispersion in some embodiments contains from 30 percent to 50 percent, or 40 percent to 50 percent, by weight solids.

Aluminum oxide hydrates other than boehmite can also be used. Boehmite can be prepared by known techniques or can be obtained commercially. Examples of commercially available boehmite include products having the trade designations "DISPERAL", and "DISPAL", both available from Sasol North America, Inc., Houston, Tex., or "HiQ-40" available from BASF Corporation, Florham Park, N.J. These aluminum oxide monohydrates are relatively pure; that is, they include relatively little, if any, hydrate phases other than monohydrates, and have a high surface area.

The physical properties of the resulting shaped ceramic abrasive particles will generally depend upon the type of material used in the alpha alumina precursor dispersion. In one embodiment, the alpha alumina precursor dispersion is in a gel state. As used herein, a "gel" is a three dimensional network of solids dispersed in a liquid.

The alpha alumina precursor dispersion may contain a modifying additive or precursor of a modifying additive. The modifying additive can function to enhance some desirable property of the abrasive particles or increase the effectiveness of the subsequent sintering step. Modifying additives or precursors of modifying additives can be in the form of soluble salts, typically water soluble salts. They typically consist of a metal-containing compound and can be a precursor of oxide of magnesium, zinc, iron, silicon, cobalt, nickel, zirconium, hafnium, chromium, yttrium, praseodymium, samarium, ytterbium, neodymium, lanthanum, gadolinium, cerium, dysprosium, erbium, titanium, and mixtures thereof. The particular concentrations of these additives that can be present in the alpha alumina precursor dispersion can be varied based on skill in the art.

Typically, the introduction of a modifying additive or precursor of a modifying additive will cause the alpha alumina precursor dispersion to gel. The alpha alumina precursor dispersion can also be induced to gel by application of heat over a period of time. The alpha alumina precursor dispersion can also contain a nucleating agent (seeding) to enhance the transformation of hydrated or calcined aluminum oxide to alpha alumina. Nucleating agents suitable for this disclosure include fine particles of alpha alumina, alpha ferric oxide or its precursor, titanium oxides and titanates, chrome oxides, or any other material that will nucleate the transformation. The amount of nucleating agent, if used, should be sufficient to effect the transformation of alpha alumina Nucleating such alpha alumina precursor dispersions is disclosed in U.S. Pat. No. 4,744,802 (Schwabel).

A peptizing agent can be added to the alpha alumina precursor dispersion to produce a more stable hydrosol or colloidal alpha alumina precursor dispersion. Suitable peptizing agents are monoprotic acids or acid compounds such as acetic acid, hydrochloric acid, formic acid, and nitric acid. Multiprotic acids can also be used but they can rapidly gel the alpha alumina precursor dispersion, making it difficult to handle or to introduce additional components thereto. Some commercial sources of boehmite contain an acid titer (such as absorbed formic or nitric acid) that will assist in forming a stable alpha alumina precursor dispersion.

The alpha alumina precursor dispersion can be formed by any suitable means, such as, for example, by simply mixing aluminum oxide monohydrate with water containing a peptizing agent or by forming an aluminum oxide monohydrate slurry to which the peptizing agent is added.

Defoamers or other suitable chemicals can be added to reduce the tendency to form bubbles or entrain air while mixing. Additional chemicals such as wetting agents, alcohols, or coupling agents can be added if desired. The alpha alumina abrasive particles may contain silica and iron oxide as disclosed in U.S. Pat. No. 5,645,619 (Erickson et al.). The alpha alumina abrasive particles may contain zirconia as disclosed in U.S. Pat. No. 5,551,963 (Larmie). Alternatively, the alpha alumina abrasive particles can have a microstructure or additives as disclosed in U.S. Pat. No. 6,277,161 (Castro).

The second process step involves providing a mold having at least one mold cavity, and preferably a plurality of cavities. The mold can have a generally planar bottom surface and a plurality of mold cavities. The plurality of cavities can be formed in a production tool. The production tool can be a belt, a sheet, a continuous web, a coating roll such as a rotogravure roll, a sleeve mounted on a coating roll, or die. In one embodiment, the production tool comprises polymeric material. Examples of suitable polymeric materials include thermoplastics such as polyesters, polycarbonates, poly(ether sulfone), poly(methyl methacrylate), polyurethanes, polyvinylchloride, polyolefin, polystyrene, polypropylene, polyethylene or combinations thereof, or thermosetting materials. In one embodiment, the entire tooling is made from a polymeric or thermoplastic material. In another embodiment, the surfaces of the tooling in contact with the sol-gel while drying, such as the surfaces of the plurality of cavities, comprises polymeric or thermoplastic materials and other portions of the tooling can be made from other materials. A suitable polymeric coating may be applied to a metal tooling to change its surface tension properties by way of example.

A polymeric or thermoplastic tool can be replicated off a metal master tool. The master tool will have the inverse pattern desired for the production tool. The master tool can be made in the same manner as the production tool. In one embodiment, the master tool is made out of metal, e.g., nickel and is diamond turned. The polymeric sheet material can be heated along with the master tool such that the polymeric material is embossed with the master tool pattern by pressing the two together. A polymeric or thermoplastic material can also be extruded or cast onto the master tool and then pressed. The thermoplastic material is cooled to solidify and produce the production tool. If a thermoplastic production tool is utilized, then care should be taken not to generate excessive heat that may distort the thermoplastic production tool limiting its life. More information concerning the design and fabrication of production tooling or master tools can be found in U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.).

Access to cavities can be from an opening in the top surface or bottom surface of the mold. In some instances, the cavities can extend for the entire thickness of the mold. Alternatively, the cavities can extend only for a portion of the thickness of the mold. In one embodiment, the top surface is substantially parallel to bottom surface of the mold with the cavities having a substantially uniform depth. At least one side of the mold, that is, the side in which the cavities are formed, can remain exposed to the surrounding atmosphere during the step in which the volatile component is removed.

The cavities have a specified three-dimensional shape to make the shaped ceramic abrasive particles. The depth dimension is equal to the perpendicular distance from the top surface to the lowermost point on the bottom surface. The depth of a given cavity can be uniform or can vary along its length and/or width. The cavities of a given mold can be of the same shape or of different shapes.

The third process step involves filling the cavities in the mold with the alpha alumina precursor dispersion (e.g., by a conventional technique). In some embodiments, a knife roll coater or vacuum slot die coater can be used. A mold release can be used to aid in removing the particles from the mold if desired. Typical mold release agents include oils such as peanut oil or mineral oil, fish oil, silicones, polytetrafluoroethylene, zinc stearate, and graphite. In general, mold release agent such as peanut oil, in a liquid, such as water or alcohol, is applied to the surfaces of the production tooling in contact with the sol-gel such that between about 0.1 mg/in$^2$ (0.02 mg/cm$^2$) to about 3.0 mg/in$^2$ 0.46 mg/cm$^2$), or between about 0.1 mg/in$^2$ (0.02 mg/cm$^2$) to about 5.0 mg/in$^2$ (0.78 mg/cm$^2$) of the mold release agent is present per unit area of the mold when a mold release is desired. In some embodiments, the top surface of the mold is coated with the alpha alumina precursor dispersion. The alpha alumina precursor dispersion can be pumped onto the top surface.

Next, a scraper or leveler bar can be used to force the alpha alumina precursor dispersion fully into the cavity of the mold. The remaining portion of the alpha alumina precursor dispersion that does not enter cavity can be removed from top surface of the mold and recycled. In some embodiments, a small portion of the alpha alumina precursor dispersion can remain on the top surface and in other embodiments the top surface is substantially free of the dispersion. The pressure applied by the scraper or leveler bar is typically less than 100 psi (0.7 MPa), less than 50 psi (0.3 MPa), or even less than 10 psi (69 kPa). In some embodiments, no exposed surface of the alpha alumina precursor dispersion extends substantially beyond the top surface to ensure uniformity in thickness of the resulting shaped ceramic abrasive particles.

The fourth process step involves removing the volatile component to dry the dispersion. Desirably, the volatile component is removed by fast evaporation rates. In some embodiments, removal of the volatile component by evaporation occurs at temperatures above the boiling point of the volatile component. An upper limit to the drying temperature often depends on the material the mold is made from. For polypropylene tooling the temperature should be less than the melting point of the plastic. In one embodiment, for a water dispersion of between about 40 to 50 percent solids and a polypropylene mold, the drying temperatures can be between about 90° C. to about 165° C., or between about 105° C. to about 150° C., or between about 105° C. to about 120° C. Higher temperatures can lead to improved production speeds but can also lead to degradation of the polypropylene tooling limiting its useful life as a mold.

The fifth process step involves removing resultant precursor shaped ceramic abrasive particles with from the mold cavities. The precursor shaped ceramic abrasive particles can be removed from the cavities by using the following processes alone or in combination on the mold: gravity, vibration, ultrasonic vibration, vacuum, or pressurized air to remove the particles from the mold cavities.

The precursor abrasive particles can be further dried outside of the mold. If the alpha alumina precursor dispersion is dried to the desired level in the mold, this additional drying step is not necessary. However, in some instances it may be economical to employ this additional drying step to minimize the time that the alpha alumina precursor dispersion resides in the mold. Typically, the precursor shaped ceramic abrasive particles will be dried from 10 to 480 minutes, or from 120 to 400 minutes, at a temperature from 50° C. to 160° C., or at 120° C. to 150° C.

The sixth process step involves calcining the precursor shaped ceramic abrasive particles. During calcining, essentially all the volatile material is removed, and the various components that were present in the alpha alumina precursor dispersion are transformed into metal oxides. The precursor shaped ceramic abrasive particles are generally heated to a temperature from 400° C. to 800° C., and maintained within this temperature range until the free water and over 90 percent by weight of any bound volatile material are removed. In an optional step, it may be desired to introduce the modifying additive by an impregnation process. A water-soluble salt can be introduced by impregnation into the pores of the calcined, precursor shaped ceramic abrasive particles. Then the precursor shaped ceramic abrasive particles are pre-fired again. This option is further described in U.S. Pat. No. 5,164,348 (Wood).

The seventh process step involves sintering the calcined, precursor shaped ceramic abrasive particles to form alpha alumina particles. Prior to sintering, the calcined, precursor shaped ceramic abrasive particles are not completely densified and thus lack the desired hardness to be used as shaped ceramic abrasive particles. Sintering takes place by heating the calcined, precursor shaped ceramic abrasive particles to a temperature of from 1,000° C. to 1,650° C. and maintaining them within this temperature range until substantially all of the alpha alumina monohydrate (or equivalent) is converted to alpha alumina and the porosity is reduced to less than 15 percent by volume. The length of time to which the calcined, precursor shaped ceramic abrasive particles must be exposed to the sintering temperature to achieve this level of conversion depends upon various factors but usually from five seconds to 48 hours is typical.

In another embodiment, the duration for the sintering step ranges from one minute to 90 minutes. After sintering, the shaped ceramic abrasive particles can have a Vickers hardness of 10 GPa, 16 GPa, 18 GPa, 20 GPa, or greater.

Other steps can be used to modify the described process such as, for example, rapidly heating the material from the calcining temperature to the sintering temperature, centrifuging the alpha alumina precursor dispersion to remove sludge and/or waste. Moreover, the process can be modified by combining two or more of the process steps if desired. Conventional process steps that can be used to modify the process of this disclosure are more fully described in U.S. Pat. No. 4,314,827 (Leitheiser).

More information concerning methods to make shaped ceramic abrasive particles is disclosed in U.S. Publ. Patent Appln. No. 2009/0165394 A1 (Culler et al.).

Figure 3:
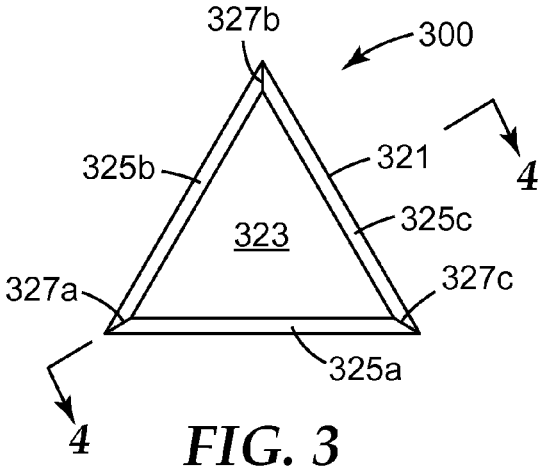
FIG. 3 is a schematic top view of an exemplary shaped ceramic abrasive particle 300.
Figure 4:
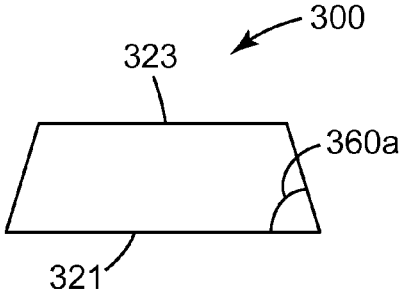
FIG. 4 is a schematic cross-sectional view of shaped ceramic abrasive particle 300, perpendicular to triangular base 321 and 325*a*, along plane 4-4 shown in FIG. 3.

Referring now to FIGS. 3 and 4, exemplary shaped ceramic abrasive particle 300 comprises a truncated regular triangular pyramid bounded by a triangular base 321, a triangular top 323, and plurality of sloping sides 325*a*, 325*b*, 325*c* connecting triangular base 321 (shown as equilateral) and triangular top 323. Slope angle 360*a* is the dihedral angle formed by the intersection of side 325*a* with triangular base 321. Similarly, slope angles 360*b* and 360*c* (both not shown), correspond to the dihedral angles formed by the respective intersections of sides 325*b* and 325*c* with triangular base 321. In the case of shaped ceramic abrasive particle 300, all of the slope angles have equal value. In some embodiments, side edges 327*a*, 327*b*, and 327*c* have an average radius of curvature of less than 50 micrometers, although this is not a requirement.

The shaped ceramic abrasive particles used in the present disclosure can typically be made using tools (i.e., molds) cut using diamond tooling, which provides higher feature definition than other fabrication alternatives such as, for example, stamping or punching. Typically, the cavities in the tool surface have planar faces that meet along sharp edges, and form the sides and top of a truncated pyramid. The resultant shaped ceramic abrasive particles have a respective nominal average shape that corresponds to the shape of cavities (e.g., truncated pyramids) in the tool surface; however, variations (e.g., random variations) from the nominal average shape may occur during manufacture, and shaped ceramic abrasive particles exhibiting such variations are included within the definition of shaped ceramic abrasive particles as used herein.

In the embodiment shown in FIGS. 3 and 4, sides 325*a*, 325*b*, 325*c* have equal dimensions and form dihedral angles with the triangular base 321 of about 82 degrees (corresponding to a slope angle of 82 degrees). However, it will be recognized that other dihedral angles (including 90 degrees) may also be used. For example, the dihedral angle between the base and each of the sides may independently range from 45 to 90 degrees, typically 70 to 90 degrees, more typically 75 to 85 degrees.

As used herein in referring to shaped ceramic abrasive particles, the term "length" refers to the maximum dimension of a shaped abrasive particle. "Width" refers to the maximum dimension of the shaped abrasive particle that is perpendicular to the length. "Thickness" or "height" refer to the dimension of the shaped abrasive particle that is perpendicular to the length and width.

The shaped ceramic abrasive particles are typically selected to have a length in a range of from 0.001 mm to 26 mm, more typically 0.1 mm to 10 mm, and more typically 0.5 mm to 5 mm, although other lengths may also be used. In some embodiments, the length may be expressed as a fraction of the thickness of the bonded composite abrasive wheel in which it is contained. For example, the shaped abrasive particle may have a length greater than half the thickness of the bonded composite abrasive wheel. In some embodiments, the length may be greater than the thickness of the bonded composite abrasive wheel.

The shaped ceramic abrasive particles are typically selected to have a width in a range of from 0.001 mm to 26 mm, more typically 0.1 mm to 10 mm, and more typically 0.5 mm to 5 mm, although other lengths may also be used.

The shaped ceramic abrasive particles are typically selected to have a thickness in a range of from 0.005 mm to 1.6 mm, more typically, from 0.2 to 1.2 mm.

In some embodiments, the shaped ceramic abrasive particles may have an aspect ratio (length to thickness) of at least 2, 3, 4, 5, 6, or more.

Surface coatings on the shaped ceramic abrasive particles may be used to improve the adhesion between the shaped ceramic abrasive particles and a binder material in abrasive articles, or can be used to aid in electrostatic deposition of the shaped ceramic abrasive particles. In one embodiment, surface coatings as described in U.S. Pat. No. 5,352,254 (Celikkaya) in an amount of 0.1 to 2 percent surface coating to shaped abrasive particle weight may be used. Such surface coatings are described in U.S. Pat. No. 5,213,591 (Celikkaya et al.); U.S. Pat. No. 5,011,508 (Wald et al.); U.S. Pat. No. 1,910,444 (Nicholson); U.S. Pat. No. 3,041,156 (Rowse et al.); U.S. Pat. No. 5,009,675 (Kunz et al.); U.S. Pat. No. 5,085,671 (Martin et al.); U.S. Pat. No. 4,997,461 (Markhoff-Matheny et al.); and U.S. Pat. No. 5,042,991 (Kunz et al.). Additionally, the surface coating may prevent the shaped abrasive particle from capping. Capping is the term to describe the phenomenon where metal particles from the workpiece being abraded become welded to the tops of the shaped ceramic abrasive particles. Surface coatings to perform the above functions are known to those of skill in the art.

Composite abrasive wheels according to the present disclosure may further comprise crushed abrasive particles (i.e., abrasive particles not resulting from breakage of the shaped ceramic abrasive particles) corresponding to an abrasive industry specified nominal grade or combination of nominal grades. If present, the crushed abrasive particles are typically of finer size grade, or grades (e.g., if a plurality of size grades are used), than the shaped ceramic abrasive particles, although this is not a requirement.

Useful crushed abrasive particles include, for example, crushed particles of fused aluminum oxide, heat treated aluminum oxide, white fused aluminum oxide, ceramic aluminum oxide materials such as those commercially available under the trade designation 3M CERAMIC ABRASIVE GRAIN from 3M Company of St. Paul, Minn., black silicon carbide, green silicon carbide, titanium diboride, boron carbide, tungsten carbide, titanium carbide, diamond, cubic boron nitride, garnet, fused alumina zirconia, sol-gel derived abrasive particles, iron oxide, chromia, ceria, zirconia, titania, silicates, tin oxide, silica (such as quartz, glass beads, glass bubbles and glass fibers) silicates (such as talc, clays (e.g., montmorillonite), feldspar, mica, calcium silicate, calcium metasilicate, sodium aluminosilicate, sodium silicate), flint, and emery. Examples of sol-gel derived abrasive particles can be found in U.S. Pat. No. 4,314,827 (Leitheiser et al.), U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.).

Abrasive particles used in the composite abrasive wheels of the present disclosure, whether crushed abrasive particles or shaped ceramic abrasive particles, may be independently sized according to an abrasives industry recognized specified nominal grade. Exemplary abrasive industry recognized grading standards include those promulgated by ANSI (American National Standards Institute), FEPA (Federation of European Producers of Abrasives), and JIS (Japanese Industrial Standard). Such industry accepted grading standards include, for example: ANSI 4, ANSI 6, ANSI 8, ANSI 16, ANSI 24, ANSI 30, ANSI 36, ANSI 40, ANSI 50, ANSI 60, ANSI 80, ANSI 100, ANSI 120, ANSI 150, ANSI 180, ANSI 220, ANSI 240, ANSI 280, ANSI 320, ANSI 360, ANSI 400, and ANSI 600; FEPA P8, FEPA P12, FEPA P16, FEPA P24, FEPA P30, FEPA P36, FEPA P40, FEPA P50, FEPA P60, FEPA P80, FEPA P100, FEPA P120, FEPA P150, FEPA P180, FEPA P220, FEPA P320, FEPA P400, FEPA P500, FEPA P600, FEPA P800, FEPA P1000, FEPA P1200; FEPA F8, FEPA F12, FEPA F16, and FEPA F24; and JIS 8, JIS 12, JIS 16, JIS 24, JIS 36, JIS 46, JIS 54, JIS 60, JIS 80, JIS 100, JIS 150, JIS 180, JIS 220, JIS 240, JIS 280, JIS 320, JIS 360, JIS 400, JIS 400, JIS 600, JIS 800, JIS 1000, JIS 1500, JIS 2500, JIS 4000, JIS 6000, JIS 8000, and JIS 10,000. More typically, the crushed aluminum oxide particles and the non-seeded sol-gel derived alumina-based abrasive particles are independently sized to ANSI 60 and 80, or FEPA F36, F46, F54 and F60 or FEPA P60 and P80 grading standards.

Alternatively, the abrasive particles (e.g., crushed abrasive particles and/or shaped ceramic abrasive particles) can be graded to a nominal screened grade using U.S.A. Standard Test Sieves conforming to ASTM E-11 "Standard Specification for Wire Cloth and Sieves for Testing Purposes". ASTM E-11 prescribes the requirements for the design and construction of testing sieves using a medium of woven wire cloth mounted in a frame for the classification of materials according to a designated particle size. A typical designation may be represented as −18+20 meaning that the shaped ceramic abrasive particles pass through a test sieve meeting ASTM E-11 specifications for the number 18 sieve and are retained on a test sieve meeting ASTM E-11 specifications for the number 20 sieve. In one embodiment, the shaped ceramic abrasive particles have a particle size such that most of the particles pass through an 18 mesh test sieve and can be retained on a 20, 25, 30, 35, 40, 45, or 50 mesh test sieve. In various embodiments, the shaped ceramic abrasive particles can have a nominal screened grade comprising: −18+20, −201+25, −25+30, −30+35, −35+40, 5−40+45, −45+50, −50+60, −60+70, −70/+80, −80+100, −100+120, −120+140, −140+170, −170+200, −200+230, −230+270, −270+325, −325+400, −400+450, −450+500, or −500+635. Alternatively, a custom mesh size could be used such as −90+100.

Abrasive particles (e.g., shaped ceramic abrasive particles and/or crushed abrasive particles) may, for example, be uniformly or non-uniformly distributed throughout the primary abrasive portion and/or secondary abrasive portion of the composite abrasive wheel. For example, abrasive particles may be concentrated toward the middle (e.g., located away from outer surfaces of), or only adjacent the outer edge, i.e., the periphery, of the composite abrasive wheel. A depressed-center portion may contain a lesser amount of abrasive particles. Preferably, the abrasive particles in the primary abrasive portion are homogenously distributed among each other, because the manufacture of the wheels is easier, and the cutting effect is optimized when the two types of abrasive particles are closely positioned to each other. Similarly, it is preferable that abrasive particles in the secondary abrasive portion are homogenously distributed among each other.

The abrasive particles may be treated with a coupling agent (e.g., an organosilane coupling agent) to enhance adhesion of the abrasive particles to the binder. The abrasive particles may be treated before combining them with the binder material, or they may be surface treated in situ by including a coupling agent to the binder material.

Composite abrasive wheels according to the present disclosure may further comprise one or more grinding aids (generally as particles) such as, for example, polytetrafluoroethylene particles, cryolite, potassium fluoroaluminate, sodium chloride, $FeS_2$ (iron disulfide), or $KBF_4$. If present, grinding aid is preferably included in an amount of from 1 to 25 percent by weight, and more preferably in an amount of from 10 to 20 percent by weight, subject to weight range requirements of the other constituents being met. Grinding aids are added to improve the cutting characteristics of the cut-off wheel, generally by reducing the temperature of the cutting interface. Examples of precisely shaped grinding aid particles are taught in U.S. Patent Appln. Publ. No. 2002/0026752 A1 (Culler et al.).

In some embodiments, the organic binder material contains plasticizer such as, for example, that available as SANTICIZER 154 PLASTICIZER from UNIVAR USA, Inc. of Chicago, Ill.

The primary abrasive portion and the secondary abrasive portion may contain additional components such as, for example, filler particles, subject to weight range requirements of the other constituents being met. Filler particles may be added to occupy space and/or provide porosity. Porosity enables the composite abrasive wheel to shed used or worn abrasive particles to expose new or fresh abrasive particles.

The primary abrasive portion and the secondary abrasive portion may have any range of porosity; for example, from about 1 percent to 50 percent, typically 1 percent to 40 percent by volume. Examples of fillers include bubbles and beads (e.g., glass, ceramic (alumina), clay, polymeric, metal), cork, gypsum, marble, limestone, flint, silica, aluminum silicate, and combinations thereof.

Composite abrasive wheels according to the present disclosure can be made according to any suitable method. In one suitable method, the non-seeded sol-gel derived alumina-based abrasive particles are coated with a coupling agent prior to mixing with the curable resole phenolic. The amount of coupling agent is generally selected such that it is present in an amount of 0.1 to 0.3 parts for every 50 to 84 parts of abrasive particles, although amounts outside this range may also be used. To the resulting mixture is added the liquid resin, as well as the curable novolac phenolic resin and the cryolite. The mixture is pressed into a mold (e.g., at an applied pressure of 20 tons per 4 inches diameter (224 kg/cm$^2$) at room temperature. The molded wheel is then cured by heating at temperatures up to about 185° C. for sufficient time to cure the curable phenolic resins.

Coupling agents are well-known to those of skill in the abrasive arts. Examples of coupling agents include trialkoxysilanes (e.g., gamma-aminopropyltriethoxysilane), titanates, and zirconates.

Composite abrasive wheels according to the present disclosure are useful, for example, as grinding wheels, including abrasives industry Type 27 (e.g., as in American National Standards Institute standard ANSI B7.1-2000 (2000) in section 1.4.14) depressed-center grinding wheels.

Composite abrasive wheels according to the present disclosure may have one or more additional layers or discs of reinforcing material integrally molded and bonded therein. One layer of reinforcing material is preferably bonded to and situated in between the secondary and primary abrasive portions of the wheel. In some embodiments, a central hub portion of the abrasive wheel adjacent the central aperture may be further reinforced with a disc of fiberglass cloth molded in and bonded to the bottom side of the primary abrasive portion. As discussed hereinabove, composite abrasive wheels according to the present disclosure may include one or more reinforcing materials (e.g., a woven fabric, a knitted fabric, a nonwoven fabric, and/or a scrim) that reinforces the composite abrasive wheel. The reinforcing material may comprise inorganic fibers (e.g., fiberglass) and/or organic fibers such as polyamide fibers, polyester fibers, or polyimide fibers. In some instances, it may be desirable to include reinforcing staple fibers within the first and/or second organic binders so that the fibers are homogeneously dispersed throughout the cut-off wheel.

In typical use, a peripheral grinding edge of the front surface of a rotating composite abrasive wheel according to the present disclosure is secured to a rotating powered tool and brought into frictional contact with a surface of a workpiece and at least a portion of the surface is abraded. If used in such a manner, the abrasive performance of the composite abrasive wheel advantageously closely resembles the abrasive performance of a single layer construction wherein the shaped ceramic abrasive particles, and any optional diluent crushed abrasive particles, are distributed throughout the abrasive wheel. Since crushed abrasive particles are typically easier to make and less expensive than shaped ceramic abrasive particles, composite abrasive wheels may achieve a level of cost savings as compared to unitary abrasive wheels containing the same shaped ceramic abrasive particles.

Advantageously, the modulus and/or thickness of the secondary abrasive portion can be varied, for example, by choosing the second organic binder to be different than the first organic binder and/or by adjusting the levels of other components in the secondary abrasive portion. For example, in some embodiments, the secondary abrasive portion is stiffer than the primary abrasive portion, while in other embodiments the primary abrasive portion is stiffer than the secondary abrasive portion.

Composite abrasive wheels according to the present disclosure can be used dry or wet. During wet grinding, the wheel is used in conjunction with water, oil-based lubricants, or water-based lubricants. Composite abrasive wheels according to the present disclosure may be particularly useful on various workpiece materials such as, for example, carbon steel sheet or bar stock and more exotic metals (e.g., stainless steel or titanium), or on softer more ferrous metals (e.g., mild steel, low alloy steels, or cast iron).

Select Embodiments of the Present Disclosure

In a first embodiment, the present disclosure provides a composite abrasive wheel comprising:

a primary abrasive portion defining a front surface, wherein the primary abrasive portion comprises shaped ceramic abrasive particles retained in a first organic binder;

a secondary abrasive portion defining a back surface opposite the front surface, wherein the secondary abrasive portion is bonded to the primary abrasive portion, wherein the secondary abrasive portion comprises secondary crushed abrasive particles retained in a second organic binder, wherein the primary abrasive portion comprises a larger volume percentage of the shaped ceramic abrasive particles than the secondary abrasive portion; and wherein the composite abrasive wheel has a central aperture therein that extends from the front surface to the back surface.

In a second embodiment, the present disclosure provides a composite abrasive wheel according to the first embodiment, wherein the secondary abrasive portion is substantially free of the shaped ceramic abrasive particles.

In a third embodiment, the present disclosure provides a composite abrasive wheel according to either the first or second embodiment, wherein the shaped ceramic abrasive particles comprise truncated triangular pyramids.

In a fourth embodiment, the present disclosure provides a composite abrasive wheel according to the third embodiment, wherein the truncated triangular pyramids have a slope angle in a range of from 75 to 85 degrees.

In a fifth embodiment, the present disclosure provides a composite abrasive wheel according to any of the first to fourth embodiments, wherein the primary abrasive portion further comprises diluent crushed abrasive particles.

In a sixth embodiment, the present disclosure provides a composite abrasive wheel according to the fifth embodiment, wherein the diluent crushed abrasive particles have a smaller mean particle size than the shaped ceramic abrasive particles.

In a seventh embodiment, the present disclosure provides a composite abrasive wheel according to any of the first to sixth embodiments, wherein the first organic binder and the second organic binder are different.

In an eighth embodiment, the present disclosure provides a composite abrasive wheel according to any of the first to seventh embodiments, wherein the shaped ceramic abrasive particles have a ratio of maximum length to thickness of from 1:1 to 8:1.

In a ninth embodiment, the present disclosure provides a composite abrasive wheel according to any of the first to seventh embodiments, wherein the shaped ceramic abrasive particles have a ratio of maximum length to thickness of from 2:1 to 5:1.

In a tenth embodiment, the present disclosure provides a composite abrasive wheel according to any of the first to ninth embodiments, wherein the shaped ceramic abrasive particles comprise sol-gel-derived shaped alumina abrasive particles.

In an eleventh embodiment, the present disclosure provides a composite abrasive wheel according to any of the first to tenth embodiments, wherein the shaped ceramic abrasive particles have a coating of inorganic particles thereon.

In a twelfth embodiment, the present disclosure provides a composite abrasive wheel according to any of the first to eleventh embodiments, wherein the primary abrasive portion further comprises a first reinforcing fabric adjacent the front surface, and wherein the secondary abrasive portion further comprises a second reinforcing fabric adjacent the back surface of the secondary abrasive portion.

In a thirteenth embodiment, the present disclosure provides a composite abrasive wheel according to any of the first to twelfth embodiments, wherein the composite abrasive wheel has a depressed center portion encircling the central aperture.

In a fourteenth embodiment, the present disclosure provides a composite abrasive wheel according to any of the first to thirteenth embodiments, the primary abrasive portion comprises from 66 to 74 percent by weight of shaped alumina abrasive particles, from 14 to 20 percent by weight of an organic binder derived from a liquid phenolic resin and a solid phenolic resin, and 10 to 15 percent by weight of grinding aid particles.

In a fifteenth embodiment, the present disclosure provides a composite abrasive wheel according to any of the first to fourteenth embodiments, wherein at least one of the first or second binder comprises an at least partially cured phenolic resin.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight.

The following abbreviations are used for materials in the examples.

TABLE OF ABBREVIATIONS

| ABBREVIATION | DESCRIPTION |
|---|---|
| AP1 | grade 36 aluminum oxide abrasive particles available as 36 BFRPL from Treibacher Schleifmettel AG, Villach, Austria. |
| AP2 | a grade 36+ precision-shaped ceramic alumina abrasive particle prepared according to the procedure described hereinbelow. |
| AP3 | abrasive particles, available as BROWN CORUNDUM # 30 from Treibacher Schleifmettel AG |
| AP4 | abrasive particles, available as SEMI-FRIABLE CORUNDUM #30 from Treibacher Schleifmettel AG |
| AP5 | abrasive particles, available as SEMI-FRIABLE CORUNDUM #36 from Treibacher Schleifmettel AG |
| AP6 | abrasive particles, available as WHITE ALUMINUM OXIDE #46 from Treibacher Schleifmettel AG |
| PR1 | liquid phenolic resin, available as DUREZ 8121 from Durez Corporation, Niagara Falls, New York. |
| PR2 | phenolic resin powder (a solid phenolic resin) available as VARCUM 29302 from Durez Corporation, Dallas, Texas. |
| PR3 | liquid phenolic resin, available as DYNEA 5136G from Dynea Oy Corp., Helsinki, Finland. |
| PR4 | phenolic resin powder mixture consisting of 25 weight percent of solid phenolic resin (available as DYNEA 82581 from Dynea Oy Corp.) and 75 weight percent of solid phenolic resin (available as HEXION 828750G from Momentive Chemical, Columbus, Ohio. |
| PR5 | phenolic resin powder mixture consisting of 25 weight percent of solid phenolic resin (available as DYNEA 82581 from Dynea Oy Corp.) and 75 weight percent of solid phenolic resin (available as BAKELITE PF 0224SP from Momentive Chemical,. |
| HC5 | 0.5-micron aluminum trihydroxide particles available as HYDRAL COAT 5 from Almatis, Inc, Leetsdale, Pennsylvania. |
| CRY | Sodium hexafluoroaluminate having the trade designation "CRYOLITE K" from Washington Mills, Tonawanda, New York. |
| SCRIM | fiberglass mesh having the trade designation "STYLE 4400" from Industrial Polymer and Chemicals, Inc., Shrewsbury, Massachusetts. |
| C500 | silicon carbide, available as C500 from ESK Elektroschmelzwerk Kempten, Frechen, Germany. |
| FIL | potassium fluoroaluminate, particle size distribution $d_{10}$ = 2.58 micrometers, $d_{50}$ = 11.5 micrometers, $d_{90}$ = 36.6 micrometers, from KBM Afflips B.V., Oss, The Netherlands. |
| CB | lamp black pigment, available as LUVOMAXX LB/S from Lehmann & Voss, Hamburg, Germany. |
| SCRIM2 | fiberglass mesh from Tissa Glasweberei AG, Oberkulm, Switzerland. |

Preparation of AP2

A boehmite sol-gel composition was made using the following recipe: aluminum oxide monohydrate powder (1600 parts) having the trade designation "DISPERAL" was dispersed by high shear mixing a solution containing water (2400 parts) and 70% aqueous nitric acid (72 parts) for 11 minutes. The resulting sol-gel was aged for at least 1 hour before coating. The sol-gel was forced into production tooling having triangular shaped mold cavities of 28 mils (0.71 mm) depth and 110 mils (2.8 mm) on each side. The draft angle $\alpha$ between the sidewall and bottom of the mold was 98 degrees. Fifty percent of the mold cavities included eight parallel ridges rising from the bottom surfaces of the cavities that intersected with one side of the triangle at a 90-degree angle, and the remaining cavities had a smooth bottom mold surface. The parallel ridges were spaced every 0.277 mm and the cross section of the ridges was a triangle shape having a height of 0.0127 mm and a 45-degree angle between the sides of each ridge at the tip. A mold release agent, a one percent solution in peanut oil in methanol was used to coat the production tooling with about 0.5 mg/in$^2$ (0.08 mg/cm$^2$) of peanut oil. The excess methanol was removed by placing sheets of the production tooling in an air convection oven for 5 minutes at 45° C. The sol-gel was forced into the cavities with a putty knife so that the openings of the production tooling were completely filled. The sol-gel coated production tooling was placed in an air convection oven at 45° C. for at least 45 minutes to dry. The resulting dried shaped particles were removed from the production tooling by passing it over an ultrasonic horn. The dried shaped particles were calcined at approximately 650° C., and then saturated with a magnesium nitrate solution (10.5 percent by weight as MgO, and having 0.02 percent by weight of HC5 dispersed therein). Excess nitrate solution was removed, and the saturated shaped particles were allowed to dry after which the particles were again calcined at 650° C. and sintered at approximately 1400° C. resulting in shaped ceramic abrasive particles. Both the calcining and sintering were accomplished using rotary tube kilns.

Mix Preparation

Five mixes were prepared according to the amounts and components listed in Table 1. Mix 1 and Mix 4 (with liquid component) were prepared by combining the indicated components using an air mixer. Mix 2 (dry ingredients) was prepared by stirring the indicated components with a paddle-type mixer for one minute. Mix 3 was prepared by combining Mix 1 and Mix 2 using a paddle-type mixer for 10 minutes. Mix 5 was prepared by combining Mix 4 and Mix 2 using a paddle-type mixer for 10 minutes.

TABLE 1

| | AMOUNT IN GRAMS | | | | |
|---|---|---|---|---|---|
| COMPONENT | Mix 1 | Mix 2 | Mix 3 | Mix 4 | Mix 5 |
| AP1 | 860 | | 860 | | |
| AP2 | | | | 860 | 860 |
| PR1 | 55 | | 55 | 55 | 55 |
| PR2 | | 155 | 155 | | 155 |
| CRY | | 155 | 155 | | 155 |

Example 1

A Type 27 depressed-center composite grinding wheel was prepared as follows. A 7-inch (18-cm) diameter disc of SCRIM was placed into a 7-inch (18-cm) diameter cavity die. Mix 3 (150 grams) was spread out evenly and a second 6.75-inch (17-cm) disc of SCRIM was placed on top of the mix. Mix 5 (200 gm) of was spread out evenly and a 5-inch (13-cm) SCRIM disc was inserted into the cavity. The filled cavity mold was then pressed at a pressure of 40 tons/38 in$^2$ (14.5 MPa).

The resulting wheel was removed from the cavity mold and placed on a spindle between depressed center aluminum plates in order to be pressed into a Type 27 depressed-center grinding wheel. The wheel was compressed at 5 ton/38 in$^2$ (1.8 MPa) to shape the disc. The wheel was then placed in an oven to cure for 7 hours at 79° C., 3 hours at 107° C., 18 hours at 185° C., and a temperature ramp-down over 4 hours to 27° C. The dimensions of the final grinding wheel were 180 mm diameter×4 mm thickness. The center hole was ⅞ inch (2.2 cm) in diameter. The resultant depressed-center composite grinding wheel was configured such that a layer containing the shaped ceramic abrasive particles (i.e., corresponding to the primary abrasive portion) was opposite the depressed center portion.

Example 2

Six mixes were prepared according to the amounts and components reported in Table 2. Mix 6 and Mix 9 (with liquid component) were prepared by mixing with an slow rotational mixer, speed 48 RPM for 6 minutes. Mix 7 and Mix 10 (dry ingredients) were prepared in high speed rotational mill mixer, speed 3000 rpm for 3 minutes. Mix 8 was Mix 6 and Mix 7 combined and mixed together with a paddle-type mixer for 10 minutes. Similarly, Mix 11 was a combination of Mix 9 and Mix 10 and mixed together with a paddle-type mixer.

TABLE 2

| COMPO- | AMOUNT IN GRAMS | | | | | |
|---|---|---|---|---|---|---|
| NENT | Mix 6 | Mix 7 | Mix 8 | Mix 9 | Mix 10 | Mix 11 |
| AP2 | 93.922 | | 72.154 | | | |
| AP3 | | | | 27.625 | | 20.595 |
| AP4 | | | | 36.833 | | 27.459 |
| AP5 | | | | 18.417 | | 13.730 |
| AP6 | | | | 9.218 | | 6.865 |
| PR3 | 6.078 | | 4.669 | 7.917 | | 5.902 |
| PR4 | | 34.280 | 7.945 | | | |
| PR5 | | | | | 41.230 | 10.493 |
| C500 | | | | | 6.444 | 1.640 |
| FIL | | 64.275 | 14.897 | | 52.326 | 13.317 |
| CB | | 1.445 | 0.335 | | | |

The grinding wheel of Example 2 was prepared according to the following procedure. Mix 8 and Mix 11 were screened through a screen with 2 mm×2 mm openings to remove agglomerates. This screened mixture was then pressed into a 7-inch (18-cm) diameter dies. A 7-inch (18-cm) disc of SCRIM2 was placed in the die. Mix 11 was then added by mineral dispenser (shutter) to fill the first half cavity of the die to form the first abrasive layer. A 6.75-inch (17-cm) diameter disc of SCRIM2 was added, and then Mix 8 was added to the second half of the die cavity by a second mineral dispenser to form the second abrasive layer containing and a 5-inch (13-cm) diameter disc of SCRIM2 fiberglass mesh was added. This mix was then pressed at 220 kg/cm$^2$.

The wheels where placed on a spindle between aluminum plates. A stack of eight plates and eight pressed wheels were compressed at 50 bar (5 MPa) pressure per stack of eight wheels, and kept under compression for curing. The wheels were placed in an oven to cure. The oven temperature was ramped up over 17 hours from 60° C. to 178° C., held at 178° C. for 7 hours, then ramped down to 60° C. over 11 hours. The heat was then turned off, and the oven was allowed to cool. The dimensions of the final composite abrasive wheels were: 7 inches (18 cm) in diameter and 0.25 inch (0.64 cm) in thickness. The center hole was ⅞ inch (2.2 cm) in diameter. The wheel weights were between 365 grams and 375 grams.

Comparative Example A

Comparative Example A was a Type 27 depressed-center grinding wheel prepared according to the procedure of Example 1, except that Mix 5 was used in both bottom and top layers. In this configuration, the shaped ceramic abrasive particles were distributed throughout the abrasive wheel.

Comparative Example B

Comparative Example B was a commercially-available Type 27 2-layer depressed-center grinding wheel comprising ceramic alumina and zirconia alumina abrasive grains, obtained as "7×0.125×⅞ NORZON PLUS Type 27 depressed center wheel" from Norton Abrasives, Worcester, Mass.

Grinding Test

Abrasive wheels (discs) were tested by grinding on a rectangular mild steel bar (0.5 in (1.3 cm)×18 in (45.7 cm)×3 in (7.6 cm)) on a 0.5 in (1.3 cm)×18 in (45.7 cm) surface by hand using a 6000 RPM air-driven grinder for ten one-minute cycles. The applied load was the grinder weight of 13 lb (5.9 kg). The steel bar was weighed before and after each cycle, and the weight loss (i.e., cut) was recorded. The steel bar was traversed 16 times from end to end per cycle. Weight loss from the grinding disc (i.e., disc wear) was recorded after each 10-cycle test. Test results are reported in Table 3 (below).

TABLE 3

| | EXAMPLE 1 | EXAMPLE 2 | COMPARATIVE EXAMPLE A | COMPARATIVE EXAMPLE B |
|---|---|---|---|---|
| | CUT, grams | | | |
| Cut cycle 1 | 53.0 | 61.6 | 62.2 | 32.5 |
| Cut cycle 2 | 42.7 | 44.4 | 40.0 | 32.3 |
| Cut cycle 3 | 37.7 | 46.3 | 37.8 | 25.6 |
| Cut cycle 4 | 36.0 | 42.6 | 37.5 | 22.9 |
| Cut cycle 5 | 36.5 | 39.5 | 36.3 | 20.6 |
| Cut cycle 6 | 36.6 | 40.8 | 36.8 | 20.9 |
| Cut cycle 7 | 32.0 | 41.6 | 31.5 | 20.1 |
| Cut cycle 8 | 30.5 | 42.5 | 34.5 | 21.3 |
| Cut cycle 9 | 32.0 | 39.6 | 30.5 | 19.5 |
| Cut cycle 10 | 35.0 | 44.7 | 33.1 | 16.1 |
| Total Cut | 372.0 | 443.6 | 380.2 | 231.8 |
| | DISC WEAR, grams | | | |
| After 10 cut cycles | 9.6 | 28 | 9.1 | 5.0 |

Various modifications and alterations of this disclosure may be made by those skilled in the art without departing from the scope and spirit of this disclosure, and it should be understood that this disclosure is not to be unduly limited to the illustrative embodiments set forth herein.

What is claimed is:

1. A composite abrasive wheel comprising:

a primary abrasive portion defining a front surface, wherein the primary abrasive portion comprises shaped ceramic abrasive particles retained in a first organic binder, and wherein the primary abrasive portion further comprises diluent crushed abrasive particles;

a secondary abrasive portion defining a back surface opposite the front surface, wherein the secondary abrasive portion is bonded to the primary abrasive portion, wherein the secondary abrasive portion comprises secondary crushed abrasive particles retained in a second organic binder, wherein the primary abrasive portion comprises a larger volume percentage of the shaped ceramic abrasive particles than the secondary abrasive portion; and wherein the composite abrasive wheel has a central aperture therein that extends from the front surface to the back surface.

2. The composite abrasive wheel of claim 1, wherein the secondary abrasive portion is substantially free of the shaped ceramic abrasive particles.

3. The composite abrasive wheel of claim 1, wherein the shaped ceramic abrasive particles comprise truncated triangular pyramids.

4. The composite abrasive wheel of claim 1, wherein the truncated triangular pyramids have a slope angle in a range of from 75 to 85 degrees.

5. The composite abrasive wheel of claim 1, wherein the diluent crushed abrasive particles have a smaller mean particle size than the shaped ceramic abrasive particles.

6. The composite abrasive wheel of claim 1, wherein the first organic binder and the second organic binder are different.

7. The composite abrasive wheel of claim 1, wherein the shaped ceramic abrasive particles have a ratio of maximum length to thickness of from 1:1 to 8:1.

8. The composite abrasive wheel of claim 1, wherein the shaped ceramic abrasive particles have a ratio of maximum length to thickness of from 2:1 to 5:1.

9. The composite abrasive wheel of claim 1, wherein the shaped ceramic abrasive particles comprise sol-gel-derived shaped alumina abrasive particles.

10. The composite abrasive wheel of claim 1, wherein the shaped ceramic abrasive particles have a coating of inorganic particles thereon.

11. The composite abrasive wheel of claim 1, wherein the primary abrasive portion further comprises a first reinforcing fabric adjacent the front surface, and wherein the secondary abrasive portion further comprises a second reinforcing fabric adjacent the back surface of the secondary abrasive portion.

12. The composite abrasive wheel of claim 1, wherein the composite abrasive wheel has a depressed center portion encircling the central aperture.

13. The composite abrasive wheel of claim 1, wherein on a total weight basis, the primary abrasive portion comprises from 66 to 74 percent by weight of shaped alumina abrasive particles, from 14 to 20 percent by weight of an organic binder derived from a liquid phenolic resin and a solid phenolic resin, and 10 to 15 percent by weight of grinding aid particles.

14. The composite abrasive wheel of claim 1, wherein at least one of the first or second binder comprises an at least partially cured phenolic resin.

15. A composite abrasive wheel comprising:

a primary abrasive portion defining a front surface, wherein the primary abrasive portion comprises shaped ceramic abrasive particles retained in a first organic binder, wherein the shaped ceramic abrasive particles comprise truncated triangular pyramids, and wherein the truncated triangular pyramids have a slope angle in a range of from 75 to 85 degrees;

a secondary abrasive portion defining a back surface opposite the front surface, wherein the secondary abrasive portion is bonded to the primary abrasive portion, wherein the secondary abrasive portion comprises secondary crushed abrasive particles retained in a second organic binder, wherein the primary abrasive portion comprises a larger volume percentage of the shaped ceramic abrasive particles than the secondary abrasive portion; and wherein the composite abrasive wheel has a central aperture therein that extends from the front surface to the back surface.

* * * * *